US006584437B2

(12) United States Patent
Heikkinen et al.

(10) Patent No.: US 6,584,437 B2
(45) Date of Patent: Jun. 24, 2003

(54) METHOD AND APPARATUS FOR CODING SUCCESSIVE PITCH PERIODS IN SPEECH SIGNAL

(75) Inventors: Ari Heikkinen, Tampere (FI); Vesa T. Ruoppila, Tampere (FI); Samuli Pietilä, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 197 days.

(21) Appl. No.: 09/878,762

(22) Filed: Jun. 11, 2001

(65) Prior Publication Data

US 2003/0004709 A1 Jan. 2, 2003

(51) Int. Cl.[7] ..... G10L 11/04
(52) U.S. Cl. ..... 704/207; 704/206
(58) Field of Search ..... 704/200, 205, 704/206, 207, 210, 258; 84/623; 375/286

(56) References Cited

U.S. PATENT DOCUMENTS

| | | | | |
|---|---|---|---|---|
| 4,704,730 A | * | 11/1987 | Turner et al. | 704/210 |
| 5,245,662 A | | 9/1993 | Taniguchi et al. | 381/36 |
| 5,388,124 A | * | 2/1995 | Laroia et al. | 375/286 |
| 5,504,834 A | * | 4/1996 | Fette et al. | 704/207 |
| 5,675,702 A | | 10/1997 | Gerson et al. | 395/2.32 |
| 5,729,694 A | | 3/1998 | Holzrichter et al. | 395/2.17 |
| 5,744,742 A | * | 4/1998 | Lindemann et al. | 84/623 |
| 6,006,175 A | | 12/1999 | Holzrichter | 704/208 |
| 6,009,394 A | * | 12/1999 | Bargar et al. | 704/258 |
| 6,185,527 B1 | | 2/2001 | Petkovic et al. | 704/231 |
| 2001/0044722 A1 | * | 11/2001 | Gustafsson et al. | 704/258 |

FOREIGN PATENT DOCUMENTS

| | | | |
|---|---|---|---|
| JP | 58215822 | 12/1983 | H03K/13/22 |
| JP | 64020599 | 1/1989 | G10L/7/08 |

OTHER PUBLICATIONS

"Vector quantization and signal compression", by Allen Gersho and Robert M. Gray, Chapter 10, pp. 309–339.

Draft ETSI EN 300 726 v7.0.1 (Jul. 1999) Digital cellular telecommunications system (Phase 2+); Enhanced Full Rate (EFR) speech transcoding; (GSM 06.60 version 7.0.1 Release 1998).

3G TS 26.090 v3.1.0 (Dec. 1999) 3rd Generation Partnership Project; Technical specification Group Services and System Aspects; Mandatory Speech Codec speech processing functions AMR speech codec; Transcoding functions (3G TS 26.090 version 3.1.0).

"Uniform distribution of points on a hyper–sphere with applications to vector bit–plane encoding", L. Lovisolo et al.; Vision, Image and Signal Processing; IEEE Proceedings—vol. 148, Issue 3, Jun. 2001, pp. 187–193.

* cited by examiner

*Primary Examiner*—Doris H. To
*Assistant Examiner*—Daniel A. Nolan
(74) *Attorney, Agent, or Firm*—Ware, Fressola, Van Der Sluys & Adolphson LLP

(57) ABSTRACT

A method and apparatus for coding successive pitch periods of a speech signal. Based on a priori knowledge of statistical properties of successive speech periods, a shaped lattice structure is designed to cover the most probable points in the pitch space. The codebook index search starts with finding an open-loop estimate in the pitch space considering all dimensions and refining the open-loop estimate in a closed-loop search separately in each dimension based on the shaped lattice structure. The closed-loop search for the first subframe is for obtaining an absolute pitch period or a delta pitch while the closed-loop search for each of the other subframes is for obtaining a delta pitch for the respective subframe.

19 Claims, 7 Drawing Sheets

METHOD AND APPARATUS FOR CODING SUCCESSIVE PITCH PERIODS IN SPEECH SIGNAL

FIELD OF THE INVENTION

The present invention relates generally to the field of speech coding and, in particular, to the quantization of successive pitch periods.

BACKGROUND OF THE INVENTION

Based on the human speech processing mechanism, the pitch period contour of voiced speech evolves slowly in time. This phenomenon is exploited in many current speech coders by coding the difference between successive pitch periods thereby increasing the coding efficiency. In a typical coder operating on a subframe basis, such as the code excited linear predictive (CELP) coder, the absolute pitch period is sent a least once per frame.

The difference between successive pitch periods is generally referred to as a delta period. In prior art, the delta periods may attain uniformly distributed values from a limited range facilitating their coding. This can be interpreted as a multi-dimensional rectangular lattice populated uniformly by points that define the delta periods over the frame. Accordingly, coding of the delta periods is carried out by using a uniform quantizer. That is, similar quantizers are used to code independently several successive delta periods. An encoder that uses such an approach is also known as a multi-dimensional rectangular lattice quantizer. In a multi-dimensional lattice quantizer, each dimension represents a pitch period in a corresponding subframe. Usually, the first dimension of a lattice is indicative of the absolute pitch period in the first subframe, while each of the remaining dimensions represents the difference between the pitch periods of the current and the preceding subframe. Thus, in a speech coding scheme where a speech frame is divided into four subframes for speech processing, the encoder for use in the quantization of successive pitch periods is referred to as a four-dimensional lattice quantizer, and the absolute pitch period in the first dimension and the delta periods in the remaining three dimensions are represented by a point ($p$, $d_1$, $d_2$, $d_3$) in a four-dimensional pitch space. In the present invention, special attention is paid to a lattice structure containing the dimensions only for the delta periods ($d_1$, $d_2$, $d_3$, . . . , $d_n$).

In most prior art speech coders utilizing differential coding, the lattice structure for n delta periods is described as a set of points with a regular arrangement in an n-dimensional pitch space such that the points are uniformly spaced throughout the pitch space. In addition to the uniform spacing of the points in the pitch space, the key feature of the prior art speech coders is the rectangular shape of the projection of the lattice points onto a two-dimensional plane. The structure of the lattice is usually constant regardless of the pitch period in the previous segment. An example of a typical two-dimensional lattice for delta periods is presented in FIG. 1, where the lattice L is defined by $$L=\{(d_1,d_2)|d_{1min}\leq d_1\leq d_{1max}\wedge d_{2min}\leq d_2\leq d_{2max}\} \quad (1)$$

The lattice covers all possible combination of $d_1$ and $d_2$ between their respective minimum and maximum values. While the lattice, as shown in FIG. 1, is two-dimensional, higher dimensional lattices can be easily derived from the two-dimensional case. In general, the minimum and maximum possible delta periods for the jth dimension are denoted by $d_{jmin}$ and $d_{jmax}$, respectively.

Once the shape and the region of the lattice quantizer are defined, an important parameter is the density of the lattice, for the density determines the bit rate of the coder. The bit rate is a monotonically increasing function of the density. Thus, the density of the lattice quantizer reflects the accuracy used for pitch period information. Normally, fractional values are used instead of integers to improve the quality of the synthesized speech.

In a typical lattice quantizer for delta periods, attention is usually paid to the boundary values ($d_{jmin}$, $d_{jmax}$) of the lattice while the rectangular shape of the lattice is kept constant. Attention is not paid, however, to the selection of a suitable set of lattice points to cover the regions of pitch space containing most of the source probability.

It is known that in a speech signal where pitch is a meaningful parameter, the evolution of pitch is smooth due to the characteristics of human speech processing mechanism. In general, the pitch period contour of voiced speech evolves slowly in time, and abrupt changes in the contour are very unlikely to happen. It has been found that a rectangular lattice structure is far from being optimal regarding the selection of lattice points to cover the regions of pitch space. Furthermore, in prior art, the search for differential pitch values is performed independently in each dimension. The use of rectangular lattices and the search method have not been optimized to reflect the known behavior of human speech.

It is advantageous and desirable to provide an improved method and system for the quantization of successive pitch periods in speech coders, taking advantage of the source probability in the pitch space to improve the quality of synthesized speech.

SUMMARY OF THE INVENTION

It is a primary object of the present invention to increase the efficiency of coding successive pitch periods thereby improving the quality of synthesized speeches in a speech coder utilizing differential coding to code the difference between successive pitch periods. This object can be achieved by defining an optimized, or more efficient, lattice structure which is shaped to cover the region of pitch space where the most probable points are located, based on a priori knowledge of the behavior of successive delta periods in voiced speech. Furthermore, regions with different point density representing different time resolution for pitch periods can be defined within the optimized lattice structure. With such an optimized lattice structure, a new method for assigning an index to a point in the optimized lattice structure and the search of the index in a codebook can be provided.

Thus, according to the first aspect of the present invention, a method of coding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, said method comprising the steps of:

shaping the lattice structure based on the point distribution pattern; and providing a codebook index representing the pitch value in each dimension of the pitch space according to the shaped lattice structure for facilitating coding of the sound signal.

According the first aspect of the present invention, the method further comprises the steps of:

obtaining an open-loop estimate of the pitch period by an open-loop search from the shaped lattice structure considering all of the dimensions of the pitch space; and refining the open-loop estimate in each of the dimensions in the pitch space separately by a closed-loop search from the shaped lattice structure for obtaining a closed-loop search value indicative of the pitch value in the respective signal segment.

According to the present invention, the pitch value is indicative of a differential pitch period or an absolute pitch period.

According to the present invention, the pitch value in at least one of the signal segments is indicative of an absolute pitch period and the pitch value in each of the remaining signal segments is indicative of a differential pitch period.

Accordingly, when the signal segments comprise sequentially a first signal segment and three second signal segments, the pitch value in the first signal segment is indicative of an absolute pitch period and the pitch value in each of the second signal segments is indicative of a differential pitch period.

Alternatively, each of the signal frames comprises four signal segments, and the pitch value in each of the four signal segments is indicative of a differential pitch period.

According to the present invention, the signal segments can be arranged in successive subframes. Thus, the pitch value in the first subframe can be an absolute pitch period or a differential pitch period, and the pitch value in each of the remaining subframes is a differential pitch period.

Preferably, each point in the lattice structure represents a distance from a reference point of the pitch space and the lattice structure is shaped to eliminate points that exceed a predetermined distance.

In particular, the shaped lattice structure of the present invention is composed of a union of non-overlapping hypercubes, which are defined by the delta period range and the time resolution in each dimension of the pitch space, and wherein each hypercube is representable by a plurality of edges comprising a number of lattice points. The index of the optimized lattice, according to the present invention, is indicative of the number of lattice points on the edges of the hypercubes.

It should be noted that a codebook index is provided and conveyed by an encoding means to a decoding means having information indicative of the shaped lattice, and wherein the decoding means synthesizes speech signal from the codebook index based on the shaped lattice.

According to the second aspect of the present invention, an apparatus for encoding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, and the lattice structure is shaped based on the point distribution pattern for defining a shaped lattice structure, said apparatus comprising:

means, responsive to the sound signal, for obtaining an open-loop estimate of the pitch period by an open-loop search from the shaped lattice structure considering all of the dimensions of the pitch space for providing an open-loop search value indicative of the open-loop estimate; and means, responsive to the open-loop search value, for refining the open-loop estimate in each of the dimensions in the pitch space separately by a closed-loop search from the shaped lattice structure for obtaining a closed-loop search value indicative of the pitch value in the respective signal segment.

According to the third aspect of the present invention, a system for coding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, and the lattice structure is shaped based on the point distribution pattern for defining a shaped lattice structure, said system comprising:

an encoder having:

means, responsive to the sound signal, for obtaining an open-loop estimate of the pitch period by an open-loop search from the shaped lattice considering all of the dimensions of the pitch space for providing an open-loop search value indicative of the open-loop estimate; and means, responsive to the open-loop search value, for refining the open-loop estimate in each of the dimensions in the pitch space separately by a closed-loop search from the shaped lattice structure for obtaining a closed-loop search value indicative of the pitch value in the respective signal segment for providing information indicative of the shaped lattice structure and the codebook indices; and a decoder having means, responsive to the information, for synthesizing a further sound signal from the codebook indices based on the shaped lattice structure.

The present invention will become apparent upon reading the description taken in conjunction with FIGS. 2 to 6.

DETAILED DESCRIPTION OF THE INVENTION

Figure 2:
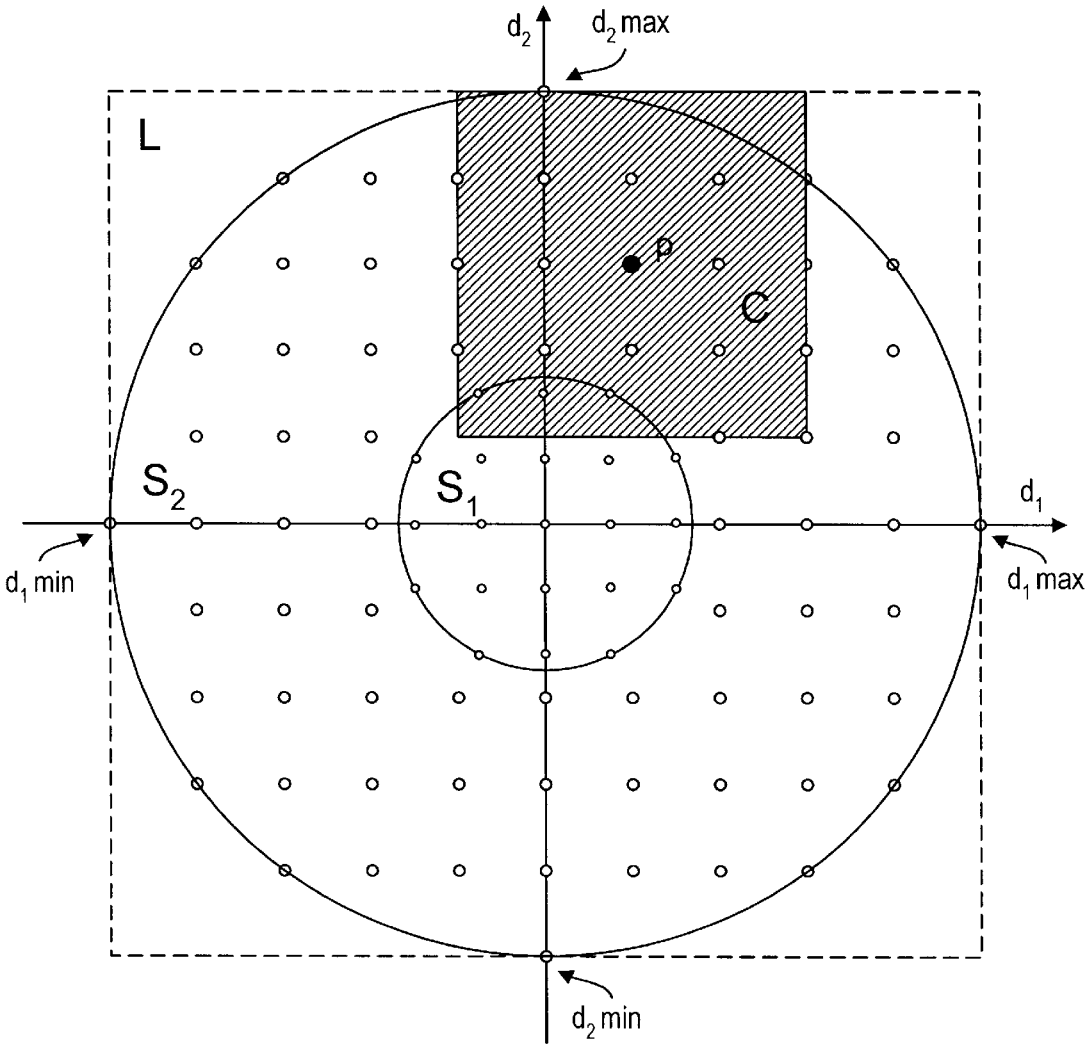
FIG. 2 is a diagrammatic representation illustrating a shaped lattice structure.

The principle of establishing a shaped lattice structure, according to the present invention, is shown in FIG. 2. In general, the lattice points in a pitch space are not evenly distributed. Rather, the distribution is defined by a plurality of regions with different point densities representing different time resolutions for pitch periods. As shown in FIG. 2, two sublattices with different point densities, denoted by $S_1$ and $S_2$, exist in the pitch space. The union of these two sublattices, or $S_1 \cup S_2$, represents an optimized lattice structure, S, defining the shaped lattice structure.

Figure 1:
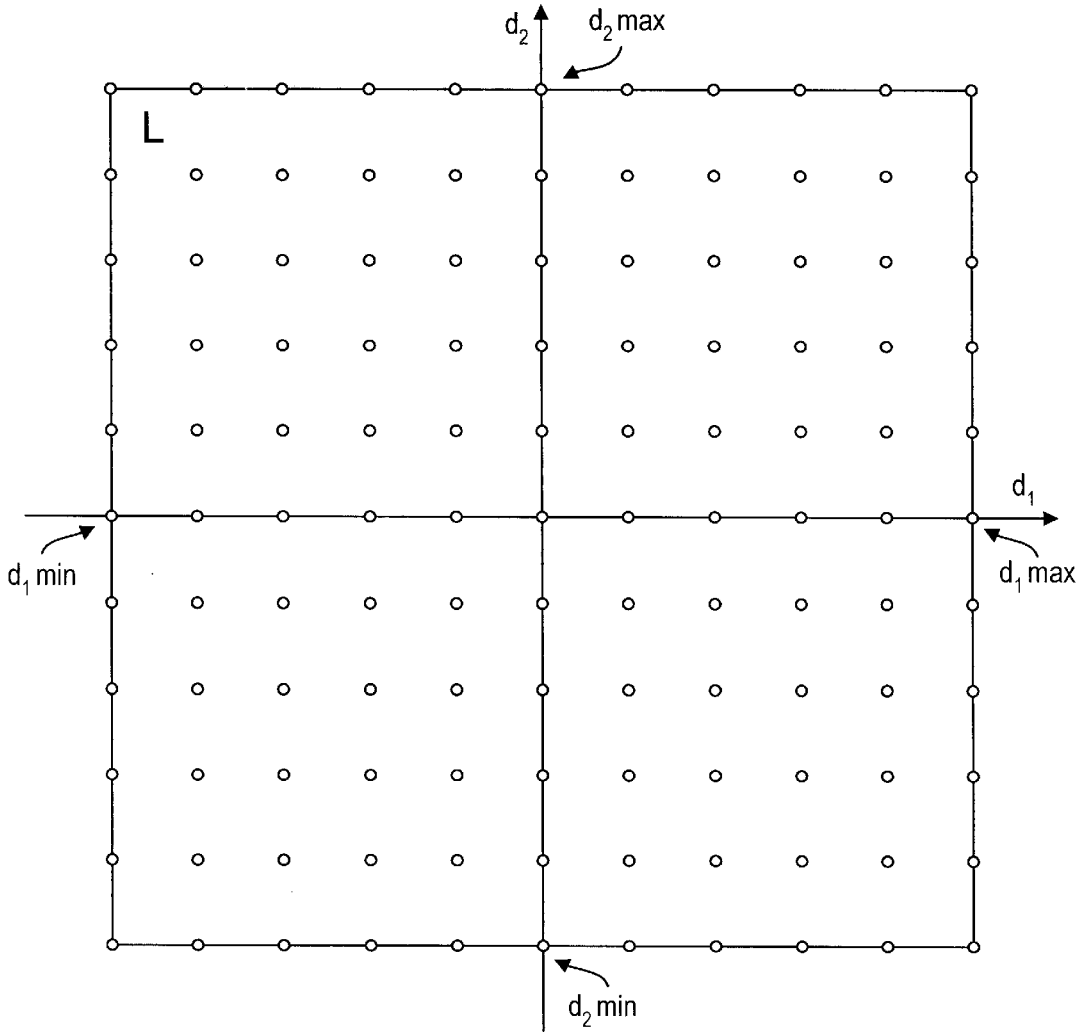
FIG. 1 is a diagrammatic representation illustrating a rectangular lattice.

As mentioned earlier, it is known that the pitch period contour of voiced speech evolves slowly in time, and abrupt changes in the contour are very unlikely to happen. Thus, within a same speech frame, it is very unlikely to have two large delta periods. For example, the corner points ($d_{1min}$, $d_{2min}$), ($d_{1max}$, $d_{2min}$), ($d_{1min}$, $d_{2max}$) and ($d_{1max}$, $d_{2max}$) and the adjacent points thereof in the lattice L, as shown in FIGS. 1 and 2, represent situation where both the delta period in $d_1$ and the delta period in $d_2$ are large. Since this situation is not likely to occur in voiced speech, these points are very unlikely to be used in a codebook index search. Accordingly, these points can be excluded from the shaped lattice S, as shown in FIG. 2, without producing noticeable effects on the resulting speech quality. As shown in FIG. 2, higher point density in the sublattice $S_1$ allows the use of a finer pitch resolution when pitch period evolves smoothly without significantly increasing the bit rate.

Because of the closed-loop structure of most existing coders utilizing differential coding of the pitch period, the index search in a lattice is carried out in a subframe basis. Thus, the search proceeds sequentially along one coordinate axis of the lattice in time. Generally, this is done by first determining a single open-loop pitch period estimate for the subframes containing the absolute pitch period and the following delta periods. Typically, integer values are used in open-loop search to reduce complexity. Thereafter, the index search is done in a closed-loop fashion sequentially for each dimension. For the first subframe, this is done in the neighborhood of the selected open-loop pitch period. For the other subframes, the search area consists of the neighborhood of the previously selected pitch period.

With the optimized lattice, according to the present invention, this approach is not practical because the possible set of lattice points in each dimension usually depends substantially on the selected point in the previous dimension.

According to the preferred method of the present invention, an estimated open-loop point in the shaped lattice is determined in the multi-dimensional space. The optimal index in each dimension, including the first dimension, is determined thereafter in a closed-loop fashion in the neighborhood of the estimated open-loop point, one dimension at a time. The dot p, as shown in FIG. 2, represents the estimated open-loop point, and the optimal index is searched from the shaded region C. The closed-loop search examines the points that belong to the intersection of the shaped lattice S and the search region C centered to the open-loop pitch estimate, p. The index determined by the closed-loop search defines uniquely the pitch period over the subframes covered by the lattice. In FIG. 2, the shaped lattice S is a subset of the lattice L. In general, this is not necessarily the case.

For illustration purposes, the shaped lattice structure is shaped as a union of non-overlapping hypercubes $D_i$, each of which is defined by the delta period range and the time resolution used in a corresponding dimension. Each of the hypercubes $D_i$ is a row of a hypercube matrix D. If a speech frame is divided into four subframes and each of the subframes is represented by a dimension in a four-dimensional pitch space, then the ith row of the matrix D defines a unique four-dimensional hypercube as follows:

$$D(i,:)=[p_{i\,min}p_{i\,max}r_{i0}d_{i1\,min}\,d_{i1\,max}r_{i1}d_{i2\,min}d_{i2\,max}r_{i2}d_{i3\,min}d_{i3\,max}r_{i3}] \quad (2)$$

where $p_{i\,min}$, $p_{i\,max}$ and $r_{i0}$ define the pitch period range and the resolution for the first subframe. The ranges of delta periods in the last three subframes are defined by $d_{ijmin}$ and $d_{ijmax}$, where j is the subframe index. The corresponding resolution in each subframe is denoted by $r_{ij}$.

With the lattice structure described above, the encoding process is quite straightforward. For encoding the index of a certain point in the shaped lattice, a starting index and the number of points in each unique edge of every hypercube are obtained. The encoding process starts by finding the index of the hypercube to which the found pitch period combination (p, $d_1$, $d_2$, $d_3$) belongs. The hypercube $D_i$ containing the point (p, $d_1$, $d_2$, $d_3$) is defined as $$D_i=\{(p,d_1,d_2,d_3)|p_{i\,min}\leq p\leq p_{i\,max}\wedge d_{ji\,min}\leq d_j\leq d_{ij\,max})j=1,2,3\} \quad (3)$$

Figure 3A:
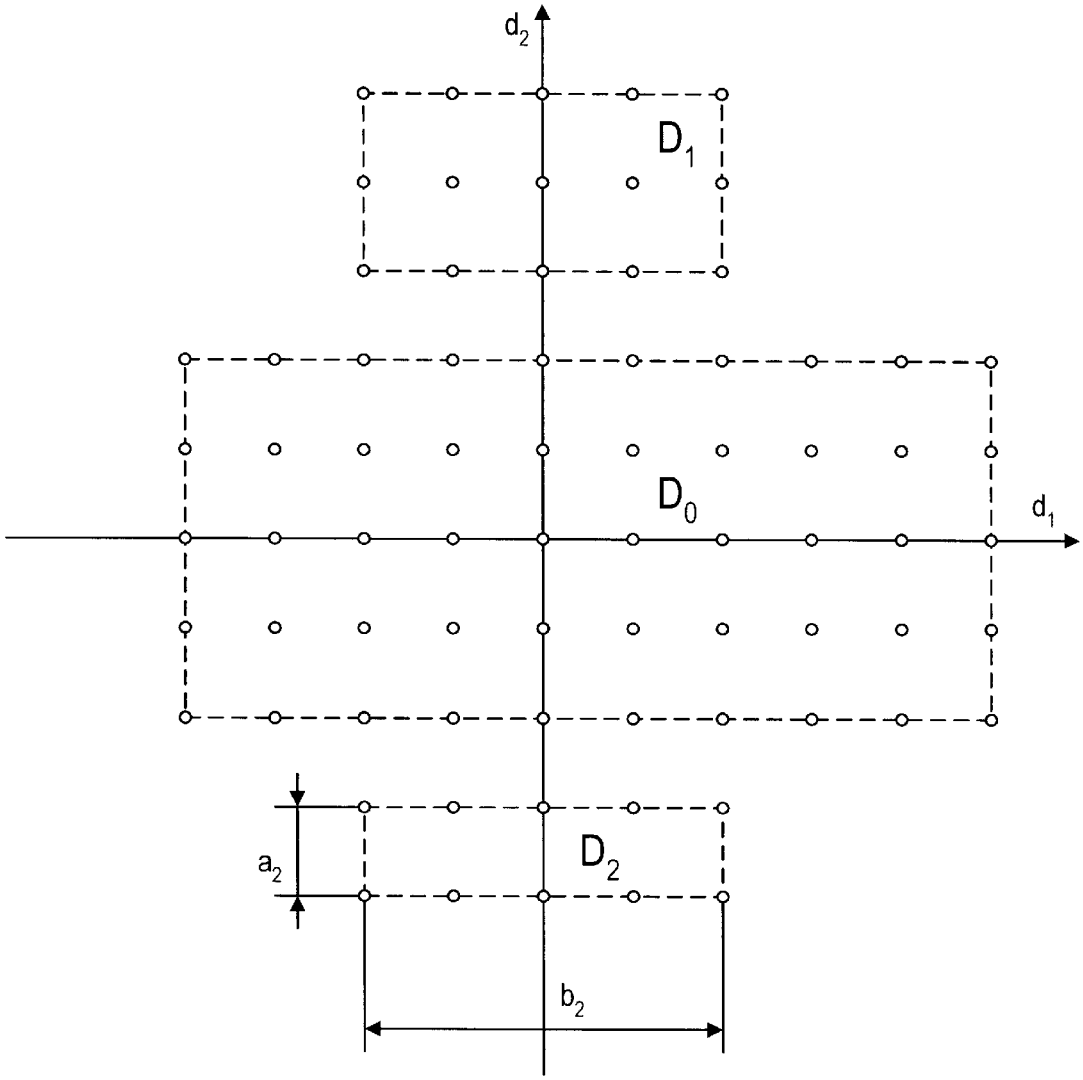
FIG. 3*a* is a diagrammatic representation illustrating the projection of a hypercube in a two-dimensional plane.
Figure 3B:
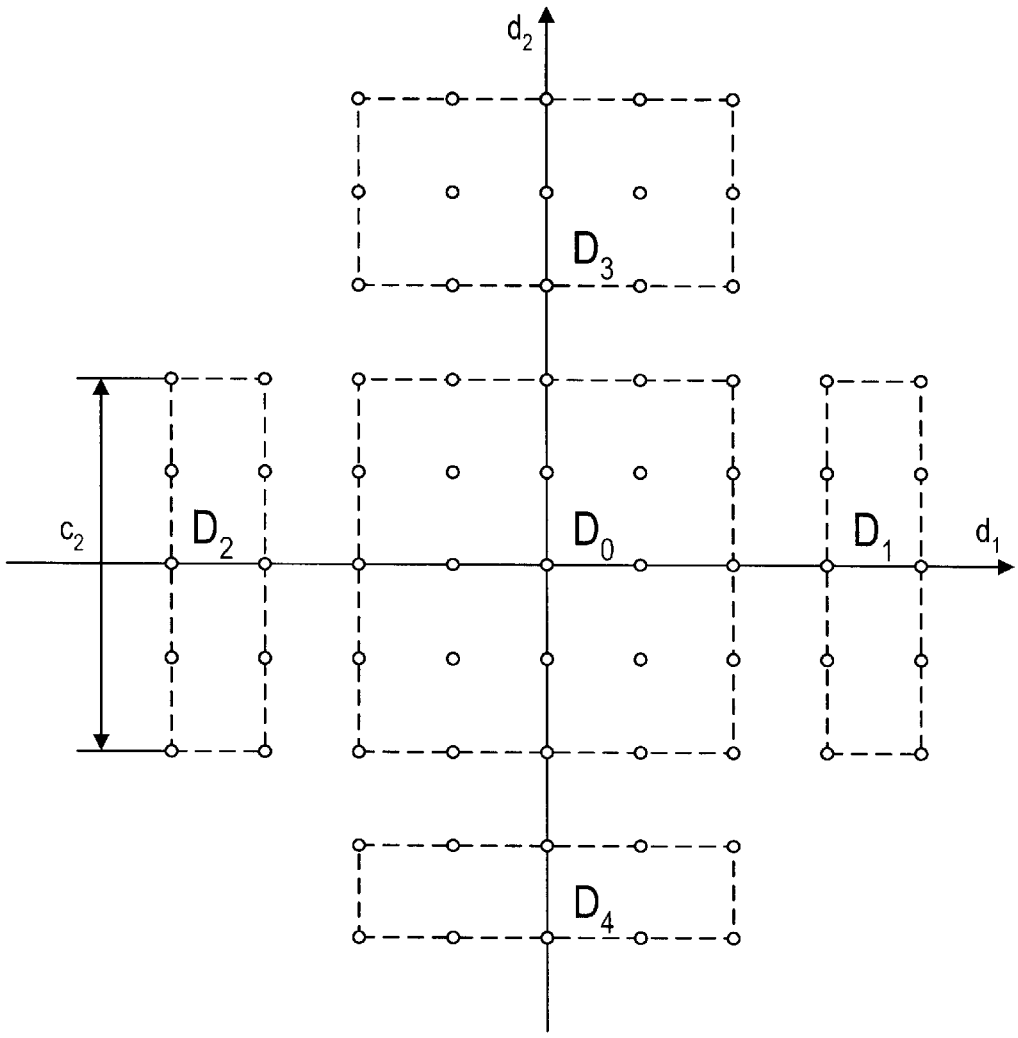
FIG. 3*b* is a diagrammatic representation illustrating the projection of the hypercube in another two-dimensional plane.

FIG. 3*a* illustrates four hypercubes $D_0$, $D_1$, $D_2$, $D_3$ as projected onto the two-dimensional plane of $d_1$, $d_2$. FIG. 3*b* illustrates the same hypercubes as projected onto the two-dimensional plane of $d_2$, $d_3$. It should be noted that, in general, the point density of one hypercube may be different from the point density of another. For simplicity, the circles, as shown in FIGS. 3*a* and 3*b*, are evenly distributed. In FIGS. 3*a* and 3*b*, different hypercubes are shown as enclosed rectangles, each of which can be defined by its unique edges. For example, the hypercube $D_2$ is defined by the edges $a_2$, $b_2$ and $c_2$.

The optimized or shaped lattice, according to the present invention, has been described in conjunction with FIGS. 2 to 3*b*. With the optimized lattice structure, according to the present invention, it is possible to define a set of indices to be transmitted to a decoder for speech synthesis as described below. The index of a point in the hypercube can be assigned by first defining the coordinates of each dimension inside the hypercube $D_i$. The coordinate $p_j$ for the (j+1)th subframe is given by $$p_0=(p-p_{i\,min})r_{i0} \quad (4)$$

$$p_j=(d_j-d_{ji\,min})r_{ij},\ \text{for } j=1,2,3 \quad (5)$$

Thus, the index s of the point (p, $d_1$, $d_2$, $d_3$) in the shaped lattice can be assigned according to $$s=s_{Di}+p_0+p_1n_{i0}+p_2n_{i1}n_{i0}+p_3n_{i2}n_{i1}n_{i0} \quad (6)$$

where $s_{Di}$ is the offset of the hypercube $D_i$. The number of points in each edge of $D_i$ in the (j+1)th dimension is denoted by $n_{ij}$. After describing the lattice in a suitable way, the next issue is to find the appropriate boundary values for it.

It should be understood that, the shaped lattice structure, as described above, is for illustration purposes only. The shaped lattice structure is not restricted to those composed of hypercubes. In general, the lattice structure is shaped by choosing the sublattices representing the point distribution pattern characteristic of the speech signal in the speech frame and subframes in a multidimensional pitch space.

Figure 4B:
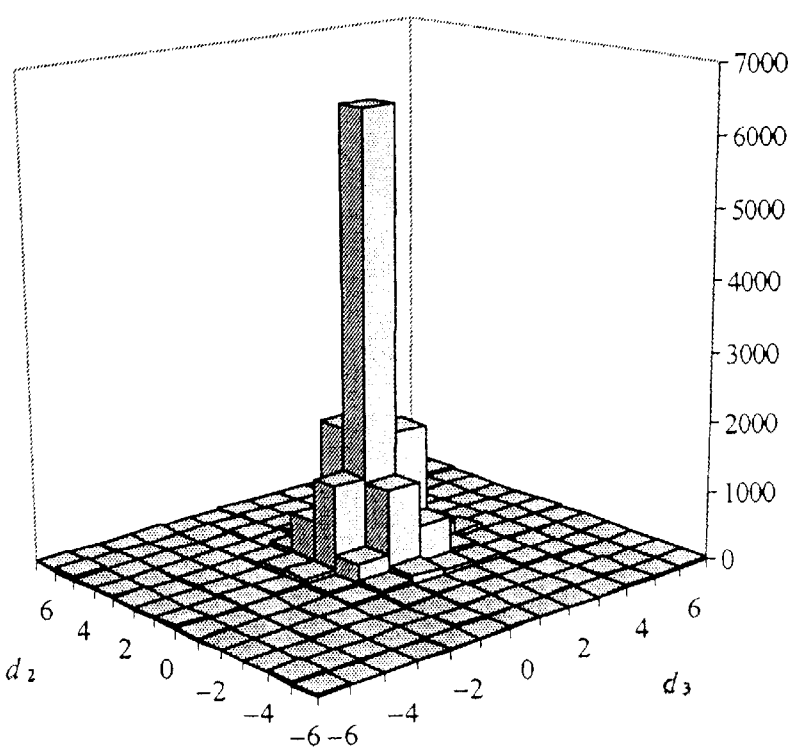
FIG. 4*b* is a histogram illustrating a point density distribution in another two-dimensional plane.
Figure 4A:
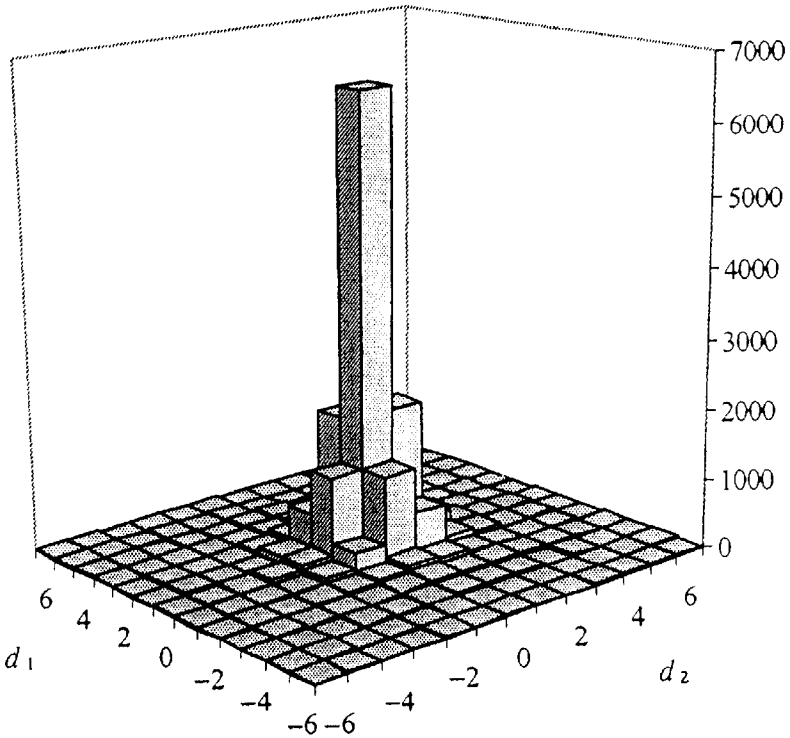
FIG. 4*a* is a histogram illustrating a point density distribution in a two-dimensional plane.

The coding method, according to the present invention, has been implemented in a modified IS-641 speech coder. In the modified IS-641 coder, the first dimension is coded in a usual way such that an absolute pitch period is sent in the first subframe. However, the shaped lattice structure including four hypercubes is used for coding the remaining three dimensions. It should be noted that, in a regular IS-641 coder, only two delta periods are sent for subframes 2 and 4. In the modified IS-641 coder, three delta periods are sent instead. Based on an experiment using 39434 frames of American-English speech spoken by a number of talkers, the distribution of delta periods derived from speech segments using the modified IS-641 speech coder is shown in FIGS. 4*a* and 4*b*. For simplicity, the delta period range is limited to ±6 samples. The difference between the pitch periods of the (i+1)th subframe and the ith subframe is denoted by $d_i$. The delta periods are rounded to integer values in the FIGS. 4*a* and 4*b* although ⅓ resolution is used in the simulation. The point-density distribution in the $d_1$, $d_2$ plane and that in the $d_2$, $d_3$ plane are shown in FIGS. 4*a* and 4*b*, respectively. As shown in FIGS. 4*a* and 4*b*, the combinations of two large delta values are rare. That is, when $d_1$ is large, $d_2$ and $d_3$ are small. But when $d_2$ or $d_3$ is large, $d_1$ is small. Thus, there is an interdependency among the delta periods in the subframes. In the prior art coder, each dimension is treated independently of each other, disregarding the interdependency among the delta periods in the subframes. In the modified IS-641, according to the present invention, the open-loop pitch value is the average pitch for the frame. The open-loop pitch value is estimated jointly in each dimension using integer resolution. This open-loop estimate is refined using closed-loop search sequentially in each dimension. For example, the closed loop-value for the first subframe is search around the estimated open-loop pitch value. The closed-loop value for the second subframe is selected around the rounded, optimal closed-loop pitch of the first subframe and so on. The possible integer value for the first subframe ranges from 20–147. As shown in FIGS. 4*a* and 4*b*, the lattice structure used is symmetric with respect to axes $d_1$, $d_2$ and $d_3$. Thus, the three dimensional lattice regarding the delta periods can be unambiguously defined by one corner point of the projection of $D_0$ to axes $d_1$ and $d_2$. In the experiment, three different optimized lattices (Shaped Lattice $S_A$, Shaped Lattice $S_B$ and Shape Lattice $S_C$) are implemented with corner points of (2⅔, 1⅔), (2⅔, ⅔) and (1⅔, ⅔), respectively, being used as the offset $S_{Di}$. As a reference, two cubic quantizers (Lattice $L_1$, Lattice $L_2$) with maximum delta periods of 2⅔ and 1⅔ are used. These ranges are selected based on the distributions presented in FIGS. 4*a* and 4*b*. The simulation results are presented in Table 1. The results are expressed as segmental signal-to-noise (SegSNR) between the voiced sections of the input speech and synthesized speech, together with the number of bits needed for the coding of the delta periods in each frame. A segment length of 64 samples is used and silent segments are discarded in the SegSNR computation. The speech sample used in all simulations consist of four sentences spoken by two male and two female talkers in clean conditions. The total length of sample is 782 frames. As it can be seen from Table I, the coding efficiency of successive pitch periods can be increased by using the optimized lattice structure, according to the present invention.

TABLE I

| | Lattice $L_1$ | Lattice $L_2$ | Shaped Lattice $S_A$ | Shaped Lattice $S_B$ | Shaped Lattice $S_c$ |
|---|---|---|---|---|---|
| SegSNR/dB | 8.24 | 8.09 | 8.28 | 8.11 | 8.05 |
| No. of bits | 12.26 | 10.38 | 11.78 | 10.00 | 9.17 |

Figure 5:
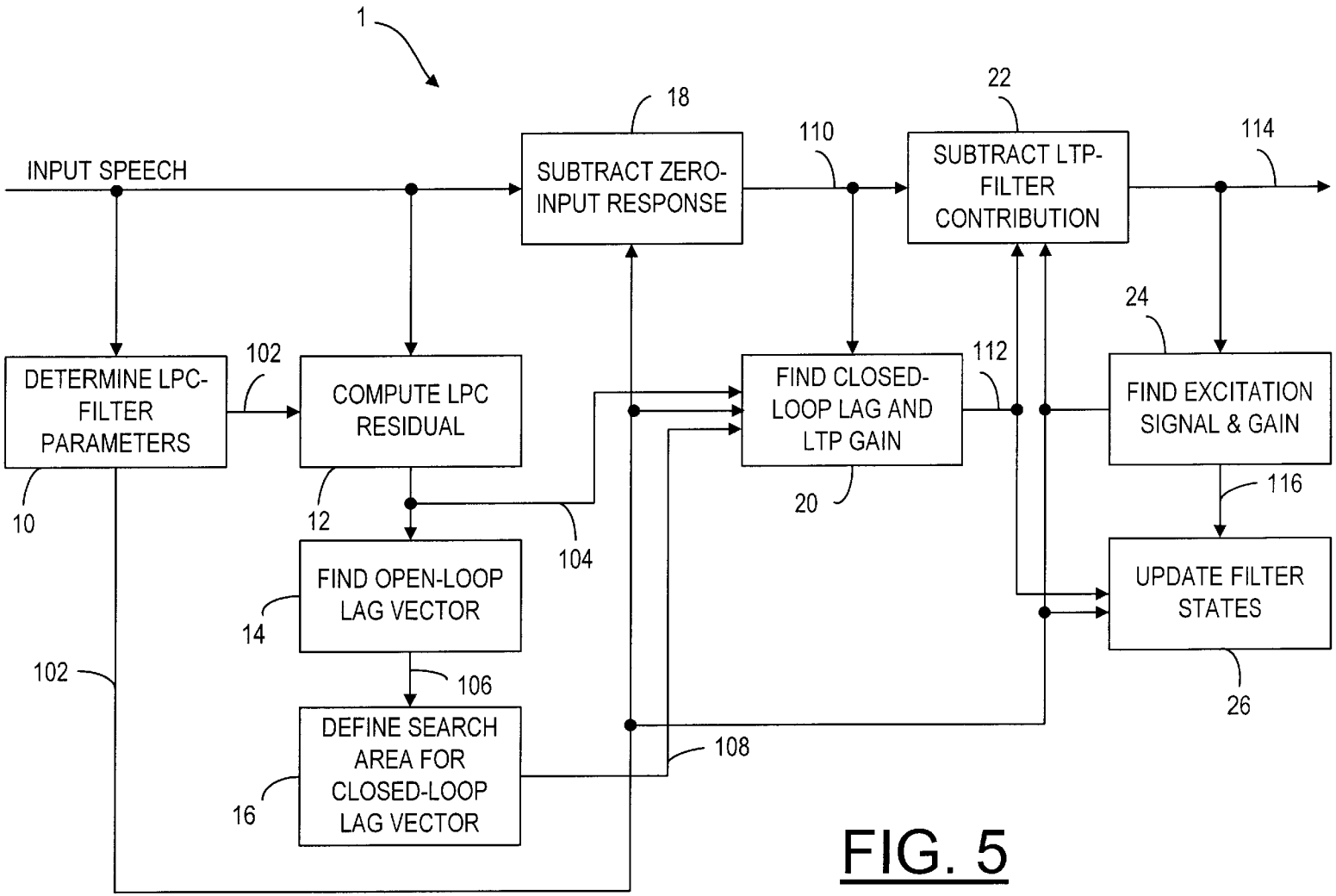
FIG. 5 is a diagrammatic representation illustrating an encoder, according to the present invention.

The speech encoder 1, according to the present invention, is shown in FIG. 5. It is based on the coding technique known as Analysis-by-Synthesis (AbS), employing linear predictive coding (LPC) technique. Typically, a cascade of time variant pitch predictor and LPC filter is used. As shown in FIG. 5, an LPC analysis with 10 is used to determine the coefficients 102 of the LPC filter based on the input speech signal. Usually, the speech signal is high-pass filtered in a pre-processing step. The pre-processed speech signal is then windowed, and autocorrelations of the windowed speech are computed. The LPC filter coefficients 102 are determined, for example, using the Levinson-Durbin algorithm. In most coders, the coefficients are not determined in every subframe. In such cases, the coefficients can be interpolated for the intermediate subframes. The pre-processing step and the LPC analysis step are known in the art. The input speech is further filtered with an inverse filter A(q,s) 12 to produce a residual signal 104. The residual signal 104 is sometimes referred to as the ideal excitation. From the shaped lattice, which is determined from a priori knowledge on the distribution of successive pitch values, an open-loop search unit 14 is used to determine an open-loop lag estimate vector 106 for the whole frame. In general, the length of the vector 106 is the same as the number of subframes, with elements corresponding to lag estimates for the individual subframes. It is also possible to search for the estimate vector 106 using the speech signal instead of the LPC residual signal 104. As all the subframes constitute the dimensions of the multi-dimensional pitch space, the search for the estimate vector 106 takes into account all these dimensions. The open-loop estimate 106, provides an open-loop lag value for each dimension in the pitch space. A search-area defining unit 16 is used to define the closed-loop search area 108 for the closed-loop lag vector in each dimension of the pitch space, based on the shaped lattice. For example, the unit 16 examines the points that belong to the intersection of the shaped lattice S and the search region C centered to the open-loop pitch estimate p, as shown in FIG. 2. From the input speech signal, a target signal 110 for the closed-loop lag search is computed in a computing unit 18 by subtracting the zero input response of the LPC filter 10 from the input speech signal, taking into account the effect of the initial states of the LPC filter 10. A closed-loop search unit 20 is used to refine the open-loop estimate 106, one dimension at a time, based on the corresponding open-loop lag value using the lattice points in the shaped lattice in that dimension for obtaining the codebook index. The codebook index is contained in the signal 112. In particular, the closed-loop search unit 20 searches for the closed-loop lag and gain by minimizing the sum-squared error between the target signal 110 for the closed-loop lag search and the synthesized speech signal represented by the LPC coefficients 102 and the LPC excitation signal. The closed-loop lag in each subframe is searched around the corresponding open-loop lag value in the defined search area 108. For lag values less than the subframe length, LTP (Long Term Predictor) memory has to be extended. This can be done by using the residual signal 104, or by copying old LTP excitation. The extension of LTP memory is known in the art. The target signal 114 for the excitation search is computed in an innovation codebook search unit 22 by subtracting the contribution 110 of the LTP filter from the target signal 112 of the closed loop lag search. The excitation signal and its gains, as collectively denoted by reference numeral 116, are searched in a computation unit 24 by minimizing the sum-squared error between the target signal 114 for the excitation search and the synthesized speech signal represented by the LPC coefficients 102 and the excitation signal. Usually, some heuristic rules are employed to avoid an exhaustive search of all possible excitation signal candidates. Finally, the filter states in the encoder 1 are updated in an updating 26 unit to keep them consistent with the filter states in the decoder. The codebook search unit 22, the computation unit 24 and the updating unit 26 are known in the art. The encoder 1, as described above, is applicable to a typical AbS or CELP coder such as IS-641.

It should be noted that, as the decoder receives the speech parameters from the encoder, the LTP excitation signal is determined by the received index and gain based on the same shaped lattice known to the decoder.

Figure 6:
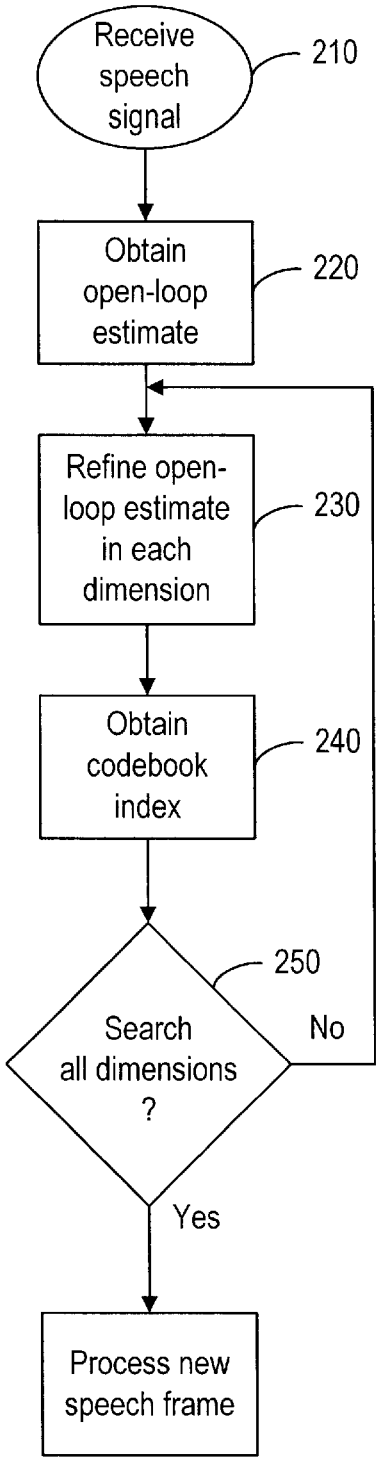
FIG. 6 is a flowchart illustrating the method of coding a speech signal, according to the present invention.

FIG. 6 is a flowchart illustrating the method of encoding a speech signal, according to the present invention. As shown in FIG. 6, as the encoder receives a speech signal at step 210, the speech signal is processed in speech frames and subframes, as known in prior art. At step 220, an open-loop search is carried out considering all the dimensions in the pitch space for obtaining an open-loop estimate of the pitch period in a speech frame. At step 230, a closed-loop search is carried out for each dimension separately to refine the open-loop estimate for obtaining a pitch value. Based on the pitch value obtained from the closed-loop search for each dimension, a codebook index is obtained at step 240. The closed-loop search for each dimension continues until the codebook indices for all subframes in a speech frame are obtained, as indicated by step 250. It should be noted that the pitch value in the first dimension of the pitch space (the first subframe for each speech frame) can be indicative of the absolute pitch period or a different pitch period (delta pitch). However, the pitch value for each of the remaining dimensions is indicative of the different pitch period in the respective subframe.

It should be understood that the present invention has been described in conjunction with the coding of a speech signal. However, the present invention is also applicable to non-speech signals, such as music.

Furthermore, while it is preferable to divide a speech frame into a plurality of subframes and search for a closed-loop pitch value in each subframe, it is possible to search for a closed-loop pitch value for a different segment of the speech frame. In general, it is possible to send different parameters a number of times per speech frame to the decoder.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of coding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, said method comprising the steps of:

shaping the lattice structure based on the point distribution pattern; and providing a codebook index representing the pitch value in each dimension of the pitch space according to the shaped lattice structure for facilitating coding of the sound signal.

2. The method of claim 1, further comprising the steps of:

obtaining an open-loop estimate of the pitch period by an open-loop search from the shaped lattice structure considering all of the dimensions of the pitch space; and refining the open-loop estimate in each of the dimensions in the pitch space separately by a closed-loop search from the shaped lattice structure for obtaining a closed-loop search value indicative of the pitch value in the respective signal segment.

3. The method of claim 2, wherein the pitch value is indicative of a differential pitch period.

4. The method of claim 2, wherein the pitch value in at least one of the signal segments is indicative of an absolute pitch period and the pitch value in each of the remaining signal segments is indicative of a differential pitch period.

5. The method of claim 2, wherein the successive signal segments sequentially comprise a first signal segment and three second signal segments, and wherein the pitch value in the first signal segment is indicative of an absolute pitch period and the pitch value in each of the second signal segments is indicative of a differential pitch period.

6. The method of claim 2, wherein the signal segments are arranged in subframes.

7. The method of claim 6, wherein each of the signal frames comprises four subframes, and wherein the pitch value in each of the four subframes is indicative of a differential pitch period.

8. The method of claim 6, wherein the subframes include sequentially a first subframe and three second subframes and where the pitch value in the first subframe is an absolute pitch period, and the pitch value in each of the second subframes is a differential pitch period.

9. The method of claim 1, wherein the point density pattern is comprised of a plurality of regions in the shaped lattice structure and each of the regions is representable of a hypercube each having a plurality of edges comprising one or more lattice points of the shaped lattice structure, and wherein the codebook index is indicative of the number of lattice points on the edges of the hypercubes.

10. The method of claim 1, wherein the codebook index is provided by an encoding means to a decoding means having information indicative of the shaped lattice structure for allowing the decoding means to synthesize a speech signal from the codebook index based on the shaped lattice structure.

11. The method of claim 1, wherein the sound signal comprises a speech signal.

12. An apparatus for encoding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, and the lattice structure is shaped based on the point distribution pattern for defining a shaped lattice structure, said apparatus comprising:

means, responsive to the sound signal, for obtaining an open-loop estimate of the pitch period by an open-loop search from the shaped lattice structure considering all of the dimensions of the pitch space for providing an open-loop search value indicative of the open-loop estimate; and means, responsive to the open-loop search value, for refining the open-loop estimate in each of the dimensions in the pitch space separately by a closed-loop search from the shaped lattice structure for obtaining a closed-loop search value indicative of the pitch value in the respective signal segment.

13. The apparatus of claim 12, wherein the pitch value is indicative of a differential pitch period.

14. The apparatus of claim 12, wherein the pitch value in at least one of the signal segments is indicative of an absolute pitch period and the pitch value in each of the remaining signal segments is indicative of a differential pitch period.

15. The apparatus of claim 12, wherein the signal segments are arranged in successive subframes.

16. The apparatus of claim 15, wherein the successive subframes sequentially comprise a first subframe and three second subframes, and wherein the pitch value in the first subframe is indicative of an absolute pitch period and the pitch value in each of the second subframes is indicative of a differential pitch period.

17. The apparatus of claim 15, wherein each of the signal frames comprises four subframes, and wherein the pitch value in each of the four subframes is indicative of a differential pitch period.

18. The apparatus of claim 12, wherein the point density pattern is comprised of a plurality of regions in the shaped lattice structure and each of the regions is representable of a hypercube each having a plurality of edges comprising one or more lattice points of the shaped lattice structure, and wherein the codebook index is indicative of the number of lattice points on the edges of the hypercubes.

19. A system for coding a sound signal in a plurality of signal frames each having a pitch period indicative of the sound signal in the respective signal frame, wherein each signal frame comprises a plurality of signal segments each representing a dimension in a pitch space, and the sound signal in each of the signal segments is characterized by a pitch value, and wherein the pitch values are representable by a point distribution pattern characteristic of the sound signal in a lattice structure for defining codebook indices in the pitch space, and the lattice structure is shaped based on the point distribution pattern for defining a shaped lattice structure, said system comprising:

an encoder having:

means, responsive to the sound signal, for obtaining an open-loop estimate of the pitch period by an open-loop search from the shaped lattice structure considering all of the dimensions of the pitch space for providing an open-loop search value indicative of the open-loop estimate; and means, responsive to the open-loop search value, for refining the open-loop estimate in each of the dimensions in the pitch space separately by a closed-loop search from the shaped lattice structure for obtaining a closed-loop search value indicative of the pitch value in the respective signal segment for providing information indicative of the shaped lattice structure and the codebook indices; and a decoder having means, responsive to the information, for synthesizing a further sound signal from the codebook indices based on the shaped lattice structure.

* * * * *

UNITED STATES PATENT AND TRADEMARK OFFICE

CERTIFICATE OF CORRECTION

PATENT NO. : 6,584,437 B2
DATED : June 24, 2003
INVENTOR(S) : Heikkinen et al.

It is certified that error appears in the above-identified patent and that said Letters Patent is hereby corrected as shown below:

Column 1,
Line 61, (equation 1) "$_{max\}}$" should be -- $_{max}\}$ --.

Column 8,
Line 3, "with" should be -- unit --.
Line 28, after "106" "," should be deleted.

Signed and Sealed this

Fourteenth Day of October, 2003

JAMES E. ROGAN
*Director of the United States Patent and Trademark Office*